US007202436B1

(12) United States Patent
Zindler

(10) Patent No.: US 7,202,436 B1
(45) Date of Patent: Apr. 10, 2007

(54) SECONDARY ARC CHUTE AND ELECTRICAL SWITCHING APPARATUS INCORPORATING SAME

(75) Inventor: Mark O. Zindler, McKees Rocks, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 11/260,970

(22) Filed: Oct. 28, 2005

(51) Int. Cl.
*H01H 33/20* (2006.01)

(52) U.S. Cl. ..... 218/149; 218/34; 218/15

(58) Field of Classification Search ..... 218/15, 218/34–40, 81, 148, 149–151; 335/201, 335/202

See application file for complete search history.

(56) References Cited

U.S. PATENT DOCUMENTS 4,546,336 A 10/1985 Petrie et al.
4,737,606 A * 4/1988 Winter ..... 218/151
4,827,231 A 5/1989 Cheski et al.
4,877,929 A * 10/1989 Rival ..... 218/20
4,973,805 A 11/1990 Paton et al.
4,975,553 A * 12/1990 Oster ..... 218/34
5,753,877 A 5/1998 Hartzel et al.
5,756,951 A * 5/1998 Manthe et al. ..... 218/35
5,818,003 A 10/1998 Moldovan et al.
5,861,596 A 1/1999 Grass et al.
5,969,314 A * 10/1999 Rakus et al. ..... 218/7
6,248,970 B1 * 6/2001 DiMarco et al. ..... 218/149
6,297,465 B1 10/2001 Groves et al.
6,417,474 B1 7/2002 Rakus et al.
6,703,576 B1 3/2004 Chou et al.

* cited by examiner

*Primary Examiner*—Elvin Enad
*Assistant Examiner*—M. Fishman
(74) *Attorney, Agent, or Firm*—Martin J. Moran

(57) ABSTRACT

A secondary arc chute is for an electrical switching apparatus including a housing, a pair of separable contacts enclosed within the housing, and a primary arc chute disposed proximate the separable contacts in order to attract an arc generated by the separable contacts. The primary arc chute has a first end including an arc horn, and a second end. The secondary arc chute includes a chute member made from a magnetic material, such as nickel-plated steel, and including a first portion disposed at or about the arc horn of the primary arc chute, and a second portion. The chute member provides an extension of the primary arc chute in order to facilitate drawing the arc away from the separable contacts and to ground the arc into the housing of the electrical switching apparatus.

20 Claims, 4 Drawing Sheets

SECONDARY ARC CHUTE AND ELECTRICAL SWITCHING APPARATUS INCORPORATING SAME

CROSS-REFERENCE TO RELATED APPLICATION

This application is related to commonly assigned, concurrently filed U.S. patent application Ser. No. 11/261,360, filed Oct. 28, 2005, entitled "Arc Plate with Runner, and Arc Chute and Electrical Switching Apparatus Incorporating Same".

BACKGROUND OF THE INVENTION

1. Field of the Invention

The present invention relates generally to electrical switching apparatus and, more particularly, to arc chutes of circuit breakers. The invention also relates to arc chutes for electrical switching apparatus and to electrical switching apparatus having arc chutes.

2. Background Information

Circuit breakers and other electrical switching apparatus (e.g., without limitation, circuit switching devices and other circuit interrupters such as contactors, motor starters, motor controllers and other load controllers) typically include a set of stationary electrical contacts and a set of moveable electrical contacts. The stationary and moveable contacts are in physical contact with one another when it is desired that the circuit breaker provide electrical current therethrough to a load. When it is desired to interrupt the circuit, however, the moveable contacts are moved away from the stationary contacts, thus removing the moveable contacts from physical contact with the stationary contacts and creating a space therebetween.

The movement of the moveable contacts away from the stationary contacts results in the formation of an electrical arc in the space between the contacts beginning at the time the contacts are initially separated. Such an arc is undesirable for a number of reasons. For one, it provides a pathway for current to flow through the circuit breaker to the load when it is desired to isolate the load from such current. Additionally, the electrical arc extending between the contacts often results in vaporization or sublimation of the contact material itself, eventually resulting in destruction or pitting of the moveable and stationary contacts. It is thus desired to eliminate any such arcs as soon as possible.

The moveable contact is typically mounted on an arm that is contained in a pivoting assembly which pivots the moveable contact away from the stationary contact. An arc chute is provided along the path of the arm to break up and dissipate such arcs. Such arc chutes typically include a plurality of spaced apart arc plates mounted in a wrapper. As the moveable contact is moved away from the stationary contact, the moveable contact moves past the ends of the arc plates, with the arc being magnetically urged toward and between the arc plates. The arc plates are electrically insulated from one another such that the arc is broken up and extinguished by the arc plates. Examples of arc chutes are disclosed in U.S. Pat. Nos. 6,703,576; 6,297,465; 5,818,003; and 4,546,336. Generally, in operation in an air circuit breaker, for example, the stack of arc plates divides-up the arc voltage in the circuit breaker in order to extinguish the arc and produce a current-limiting effect, thereby providing downstream protection. This cools the arc and splits the same into series arcs. Cooling, in turn, results from arc attachment to the arc plates. Arc cooling also depends on the gas flow over the plates (e.g., convection) and hot gas removal out of a vent in the circuit breaker housing.

Arc plate geometry, the number of plates within the arc chute, and other parameters, such as spacing between arc plates, have evolved over the years as attempts have been made to provide optimum arc dissipation. Additionally, many arc chute designs employ devices such as, for example, an arc horn, or other structure which is specifically designed to draw the arc into the arc chute. See, e.g., U.S. Pat. No. 6,417,474. An arc horn generally comprises an extension of an arc plate which is bent or otherwise directed toward the direction in which it is desired to coax the arc. Such devices are most often present on the first arc plate among the stack of arc plates in the arc chute, and are designed to draw the arc away from the separable contacts, upward into the other arc plates. However, the arc has a tendency to follow the inside edge of the arc chute adjacent the separable contacts which can cause heavy erosion of the arc plates and damage to the nearby separable contacts.

There is, therefore, room for improvement in arc chutes for electrical switching apparatus, and in electrical switching apparatus having arc chutes.

SUMMARY OF THE INVENTION

These needs and others are met by the present invention, which is directed to a secondary arc chute for an electrical switching apparatus.

As one aspect of the invention, a secondary arc chute is provided for an electrical switching apparatus. The electrical switching apparatus includes a housing, a pair of separable contacts enclosed within the housing, and a primary arc chute disposed proximate the separable contacts in order to attract an arc generated by the separable contacts. The primary arc chute has a first end including an arc horn, and a second end. The secondary arc chute comprises: a chute member including a first portion structured to be disposed at or about the arc horn of the primary arc chute, and a second portion, wherein the chute member is structured to provide an extension of the primary arc chute in order to facilitate drawing the arc away from the separable contacts, to cool and dissipate the arc, and to ground the arc into the housing of the electrical switching apparatus.

The first portion of the chute member may comprise a hook structured to attract the arc. The hook may include a tip structured to be disposed proximate the arc horn at or about the first end of the primary arc chute. The tip of the hook may comprise a first arc runner extension and the second portion of the chute member may include a second arc runner extension wherein the first and second arc runner extensions are structured to attract the arc from the arc horn. The second portion of the chute member may also include a pair of opposing tab extensions which extend generally vertically from the second portion wherein the pair of opposing tab extensions are structured to be disposed proximate the arc horn of the primary arc chute in order to further attract and dissipate the arc.

The chute member may comprise a single-piece chute member. The single-piece chute member may be made from a metallic material and may include a number of bends. The chute member may also be made from a magnetic material, such as for example, without limitation, nickel-plated steel.

As another aspect of the invention, an electrical switching apparatus comprises: a housing; separable contacts enclosed within the housing; an operating mechanism structured to open and close the separable contacts; a primary arc chute disposed proximate the separable contacts in order to attract an arc generated by the separable contacts, the primary arc chute including an end; and a secondary arc chute comprising: a chute member including a first portion disposed at or about the end of the primary arc chute, and a second portion, the first portion of the chute member being structured to draw the arc out of the primary arc chute and away from the separable contacts, the second portion of the chute member being structured to ground the arc into the housing of the electrical switching apparatus.

The end of the primary arc chute may include an arc horn and the first portion of the chute member may include a hook disposed proximate the arc horn at or about the end of the primary arc chute. The secondary arc chute may be coupled to the housing of the electrical switching apparatus. More specifically, the second portion of the chute member may include an opening and the secondary arc chute may further include at least one fastener inserted through the opening in order to secure the chute member to the housing. Alternatively, the secondary arc chute may be coupled to the primary arc chute.

The secondary arc chute may have a surface area and the chute member includes a number of surface area enlarging mechanisms selected from the group consisting of openings, hooks, tab extensions, fins, and a combination of openings, hooks, tab extensions and fins, wherein the surface area enlarging mechanisms are structured to enlarge the surface area of the secondary arc chute in order to further attract, dissipate and cool the arc.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
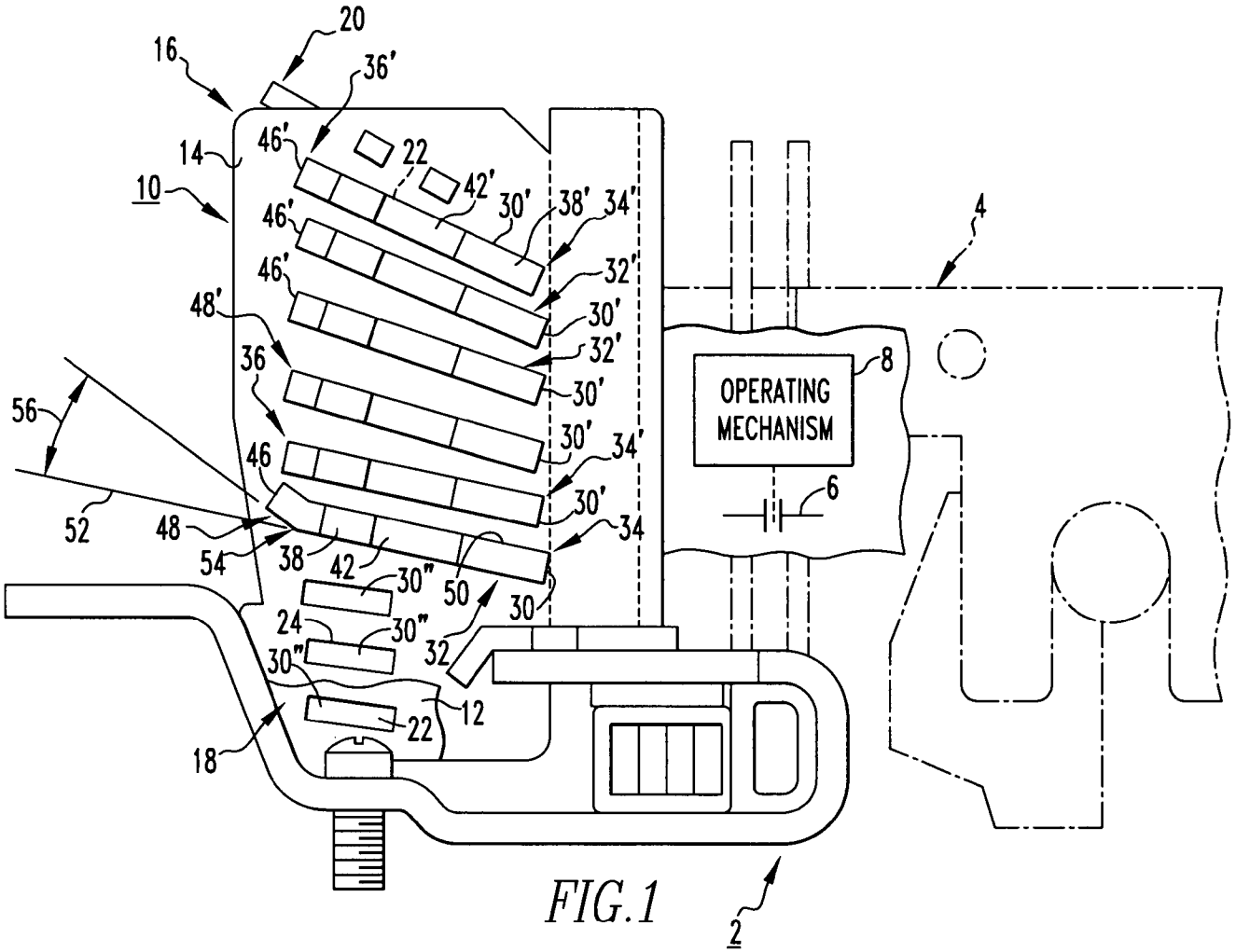
FIG. 1 is a vertical elevational view of an arc chute of a molded case circuit breaker employing arc plates.

For purposes of illustration, the invention will be described as applied to the arc chute of a molded case circuit breaker, although it will become apparent that it could also be applied to a wide variety of electrical switching apparatus (e.g., without limitation, circuit switching devices and other circuit interrupters such as contactors, motor starters, motor controllers and other load controllers) having an arc chute with a plurality of arc plates.

Directional phrases used herein, such as, for example, left, right, top, bottom, front, back and derivatives thereof, relate to the orientation of the elements shown in the drawings and are not limiting upon the claims unless expressly recited therein.

As employed herein, the term "fastener" refers to any suitable connecting or tightening mechanism expressly including, but not limited to, screws, bolts and the combinations of bolts and nuts (e.g., without limitation, lock nuts) and bolts, washers and nuts.

As employed herein, the statement that two or more parts are "coupled" together shall mean that the parts are joined together either directly or joined through one or more intermediate parts.

As employed herein, the term "secondary" shall refer to a component which is structured to assist, supplement or otherwise improve upon the functionality of one or more primary components. For example, the secondary arc chute disclosed herein is intended to be used in combination with the existing primary arc chute in order to supplement (i.e., improve) the arc cooling and dissipating capabilities of the same.

As employed herein, the term "number" shall mean one or more than one (i.e., a plurality).

Referring to the figures, an electrical switching apparatus, such as a molded case circuit breaker 2, in accordance with aspects of the invention includes a housing 4, separable contacts 6 enclosed within the housing 4, and an operating mechanism 8 which is structured to open and close the separable contacts 6 and to trip open the separable contacts 6 in response to a trip condition (e.g., without limitation, an overcurrent condition, an overload condition, an undervoltage condition, or a relatively high level short circuit or fault condition), as is well known. For simplicity of illustration, the separable contacts 6 and operating mechanism 8 are shown in simplified form in FIG. 1. An arc chute 10 is disposed adjacent to the separable contacts 6 in order to attract and dissipate an arc which is generated by the separable contacts 6, when opened.

As shown in FIG. 1, the arc chute 10 generally comprises a support structure 12, 14 which holds a plurality of arc plates 30, 30', 30" in a spaced, stacked relation proximate the separable contacts 6. At least some of the arc plates 30, 30' include a first end 34, 34' which is disposed generally proximate the separable contacts 6, and a second end 36, 36' which is disposed distal from the separable contacts 6. At least one of the arc plates 30, 30' includes an integral arc runner 46, 46' which is structured to draw the aforementioned arc into the arc chute 10 and toward the second ends 36, 36' of the arc plates 30, 30'. In this manner, the arc chute 10 of the invention functions not only to draw the arc into the arc chute 10, as is conventionally known, but further to attract such arc to the back (e.g., toward second ends 36, 36' of arc plates 30, 30') of the arc chute 10, thereby directing the arc as far away from the separable contacts 6 as possible in order to avoid arc damage to the separable contacts 6 and to reduce arc plate erosion.

In the example of FIG. 1, the arc chute 10 includes an arc horn 20 and nine arc plates 30, 30' 30" supported by the support structure which comprises a pair of opposing side walls 12, 14 (side wall 12 has been substantially cut away in FIG. 1 to show internal structures of arc chute 10). The opposing side walls 12, 14 have openings or slots 22, 24 structured to receive corresponding first and second protrusions 42, 42' (FIG. 1), 44, 44' (FIG. 4) which protrude laterally from the first and second sides 38, 38' (FIG. 1), 40, 40' (FIG. 4) of the arc plates 30, 30' (best shown in FIG. 2). Included among the nine arc plates in the example of FIG. 1, are one first arc plate 30, five second arc plates 30', and three third arc plates 30". The second arc plates 30' are generally disposed towards the first end 16 or top (from the perspective of FIG. 1) of the arc chute 10, while the third arc plates 30" are generally disposed towards the second end 18 or bottom, as shown. The exemplary first arc plate 30 constitutes the fourth arc plate up from the bottom (from the perspective of FIG. 1) or second end 18 of the arc chute 10, and is disposed intermediate the second and third arc plates 30', 30". It will be appreciated, however, that any suitable number of each type of arc plate 30, 30', 30" could be employed in any suitable arc chute configuration other than the configuration shown and described with respect to the example of FIG. 1.

Figure 2:
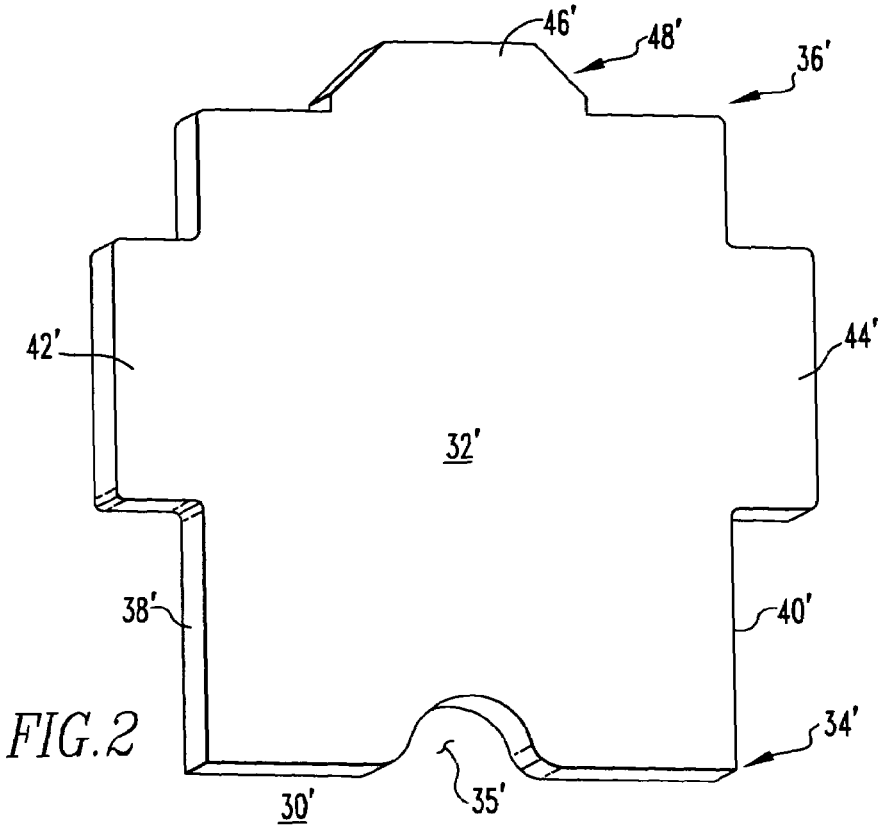
FIG. 2 is an isometric view of one of the arc plates of FIG. 1.

A further understanding of the arc plates 30, 30' in accordance with aspects of the invention will be had with reference to FIG. 2. For simplicity of disclosure, the structure of the second arc plates 30', will first be described as shown in FIG. 2. Then, with reference to FIG. 1, differences between the second arc plate 30' and first arc plate 30 will be discussed. In this regard, it will be appreciated that the first and second arc plates 30, 30' are substantially similar in structure except for the fact that the arc runner 46 of first arc plate 30 includes at least one bend, as will be discussed herein.

In the example of FIG. 2, the arc plate 30' comprises a plate member 32' which is structured to be secured between the pair of opposing side walls 12, 14 (FIG. 1) by way of the first and second protrusions 42', 44', as previously discussed. The first end 34' of the arc plate 30' which, when assembled within the arc chute 10 (FIG. 1), is disposed generally proximate the separable contacts 6 (FIG. 1), includes a notch or throat 35'. The throat 35' is structured to accommodate the path of a moving arm carrying a moveable contact (not shown) of the separable contacts 6 (FIG. 1). The second end 36' of the plate member 32' includes the aforementioned arc runner 46' which comprises an integral protrusion, such as the tab extension 46' shown. The exemplary integral tab extension 46' includes a tapered portion 48' which is structured to further attract the arc. More specifically, the arc plate 30' is contemplated as being made from any known or suitable magnetic material, such as for example, without limitation, nickel-plated steel. Accordingly, the tapered portion 48' of integral arc runner 46' provides a location of consolidated magnetic flux which has a tendency to attract the arc toward it, and thus away from first end 34', as desired.

Referring back to FIG. 1, it will be understood that the first arc plate 30 includes all of the foregoing structures (e.g., plate member 32, tab extension 46, and tapered portion 48) except the arc runner 46'. The arc runner 46 of the first arc plate 30, however, is bent upward (from the perspective of FIG. 1) in order to direct the arc toward the second end 36' of the second arc plates 30', which are substantially straight. Specifically, the plate member 32 includes a body portion 50 which lies in a plane 52, and the integral tab extension arc runner 46 includes a bend 54 proximate the second end 36 in order that the tab extension 46 forms an angle 56 with respect to the plane 52, as shown. The angle 56 is preferably between about 20 degrees and about 50 degrees with respect to the plane 52 of the body portion 50 of first arc plate 30. However, it will be appreciated that any suitable angle, or alternative arc runner configuration (not shown), could be employed. For example, without limitation, the arc runner 46 could include more than one bend (not shown). It will also be appreciated that the integral tab extension which comprises the arc runner 46 of first arc plate 30 is slightly longer than the arc runner 46' of second arc plates 30', which are substantially straight. This added length, the exact amount of which is not meant to be limiting upon the invention, accounts for the bend 54 in first arc plate 30 while allowing the arc runner 46 thereof to be directed toward the second end 36' of the adjacent second arc plate 30', as shown in FIG. 1.

Accordingly, aspects of the present invention provide an arc chute 10 having arc plates 30, 30' which effectively draw the arc into the chute to the location within the chute 10 most distal from the separable contacts 6.

Figure 3:
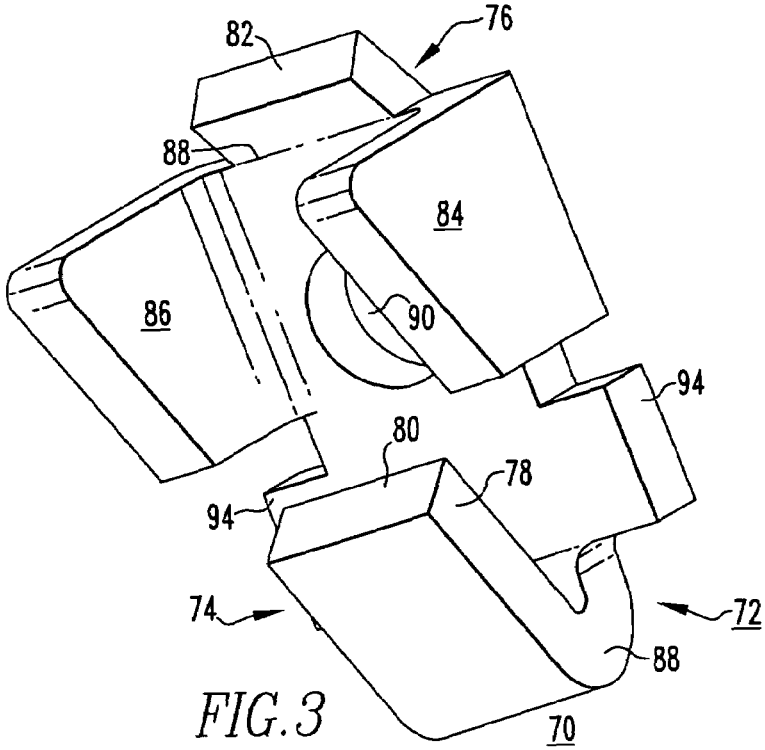
FIG. 3 is an isometric view of a secondary arc chute in accordance with the present invention.
Figure 4:
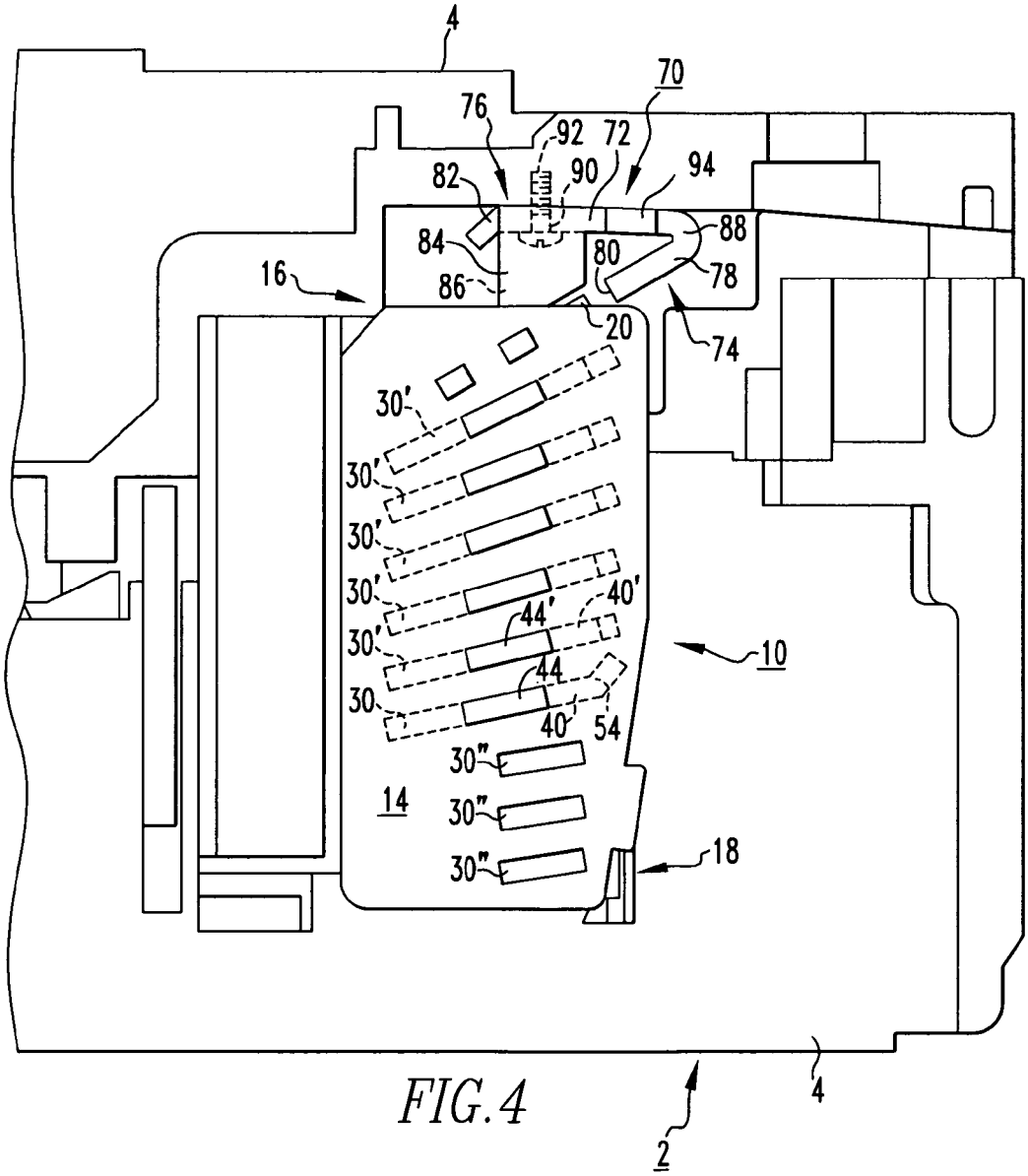
FIG. 4 is a vertical elevational view of the secondary arc chute of FIG. 3 as employed in a molded case circuit breaker along with the arc chute of FIG. 1.
Figure 5:
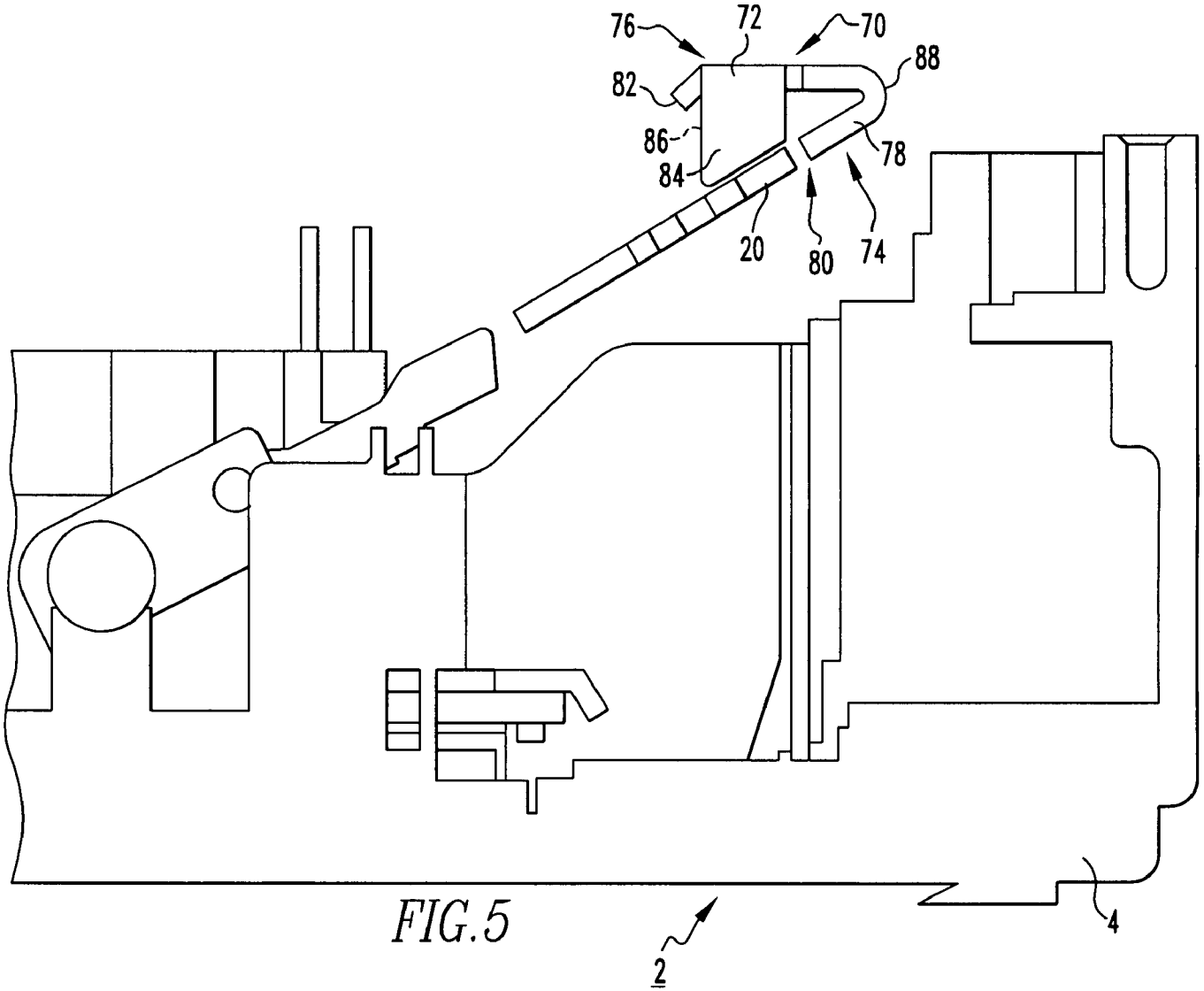
FIG. 5 is a vertical elevational view of the secondary arc chute and portions of the molded case circuit breaker of FIG. 4, with all but one arc plate of the arc chute removed.

FIGS. 3, 4 and 5 show a secondary arc chute 70 for an electrical switching apparatus, such as the aforementioned circuit breaker 2, in accordance with the invention. It will be appreciated that the secondary arc chute 70 may be used in combination with the aforementioned arc chute 10 having arc plates 30, 30' or alternatively, with any known or suitable conventional arc chute (not shown). In either circumstance, the existing arc chute (e.g., arc chute 10) is the primary arc chute.

As shown in FIG. 3, the secondary arc chute 70 generally comprises a chute member 72 which, in the example shown, is a single-piece member made from any known or suitable metallic material. For example, like the aforementioned arc plates 30, 30', the chute member 72 of the exemplary secondary arc chute 70 is contemplated as being made from a magnetic material, such as for example, without limitation, nickel-plated steel. The chute member 72 includes a first portion 74 structured to be disposed at or about the arc horn 20 (FIGS. 4 and 5) at the first end 16 (FIG. 4) of the primary arc chute 10 (FIG. 4) and a second portion 76.

The first portion 74 of the chute member 72 comprises a hook 78. The hook 78 includes a tip 80 which forms a first arc runner extension 80 structured to be disposed proximate the arc horn 20, as shown in FIG. 4. The second portion 76 of the chute member 72 includes a second arc runner extension 82. The first and second arc runner extensions 80, 82 are structured to attract the arc from the arc horn 20 (FIGS. 4 and 5) of the primary arc chute 10 in order to facilitate drawing the arc away from the separable contacts 6 (FIG. 1) of the circuit breaker 2 (FIG. 1). To further attract and dissipate the arc, the second portion 76 of the chute member 72 further includes a pair of opposing tab extensions 84, 86 which extend generally vertically from the second portion 76, as shown. The chute member 72 includes a number of bends 88 in order to create, for example, the aforementioned hook 78, second arc runner extension 82, and opposing tab extensions 84, 86. These structures, in addition to an opening 90 and pair of fins 94, as shown, serve to provide areas of concentrated magnetic flux having a tendency to attract the arc, as desired. These features also constitute surface area enlarging mechanisms which are structured to enlarge the surface area of the secondary arc chute 70. It will be appreciated that any suitable combination of surface area enlarging mechanisms 78, 84, 86, 90, 94 other than the hook 78, tab extension 84, 86, opening 90, and configuration of fins 94 as shown, could be employed in order to further attract, dissipate and cool the arc.

As shown in FIG. 4, the secondary arc chute 70 is coupled to the housing 4 of the circuit breaker 2 and, although the exemplary secondary arc chute 70 is not coupled directly to the arc horn 20 of the primary arc chute 10 in the example shown, it will be appreciated that in other embodiments of the invention it could be so coupled without departing from the scope of the invention. In the example of FIGS. 4 and 5, the tip 80 of hook 78 and the tab extensions 84, 86 are disposed adjacent to, but are not touching the arc horn 20 (best shown in FIG. 5). The exact spacing between these components is not meant to be a limiting aspect of the invention. The secondary arc chute 70 is coupled to the housing 4 by way of a fastener, such as the screw 92 (shown in hidden line drawing in FIG. 4). The screw 92 is inserted through opening 90 (best shown in FIG. 3) of the chute member 72 and suitably tightened, in order to secure the chute member 72 in the aforementioned configuration. It will, however, be appreciated that any known or suitable fastening mechanism (not shown) other than the exemplary screw 92, could be employed. For example, without limitation, the chute member 72 could be adhered using any known or suitable adhesive or it could be coupled with an interlocking arrangement (not shown) with the housing. It will be appreciated, therefore, that the secondary arc chute 70 also functions to ground the arc into the housing 4.

Accordingly, the secondary arc chute 70 of the invention provides a supplemental arc dissipating mechanism which attracts the arc and further facilitates drawing it away from the separable contacts 6 (FIG. 1) of the circuit breaker 2 (FIG. 1) while also providing a variety of surface area enlarging mechanisms (e.g., hook 78, arc runner extensions 80, 82, tab extensions 84, 86, openings 90, and fins 94 to attract, cool and dissipate the arc, as well as to ground the arc into the housing 4 of circuit breaker 2.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A secondary arc chute for an electrical switching apparatus, said electrical switching apparatus including a housing, a pair of separable contacts enclosed within said housing, and a primary arc chute disposed proximate said separable contacts in order to attract an arc generated by said separable contacts, said primary arc chute having a first end including an arc horn, and a second end, said arc horn having a plane, said secondary arc chute comprising:

a chute member including a first portion structured to be disposed at or about said arc horn of said primary arc chute, and a second portion, wherein said chute member is structured to provide an extension of said primary arc chute in order to facilitate drawing said arc away from said separable contacts, wherein said first portion of said chute member of said secondary arc chute is structured to align with said plane of said arc horn of said primary arc chute.

2. The secondary arc chute of claim 1 wherein the first portion of said chute member comprises a hook structured to attract said arc; wherein said hook includes a tip; and wherein said tip is structured to be disposed proximate said arc horn at or about the first end of said primary arc chute.

3. The secondary arc chute of claim 2 wherein said tip of said hook comprises a first arc runner extension; wherein the second portion of said chute member includes a second arc runner extension; and wherein said first and second arc runner extensions are structured to attract said arc from said arc horn.

4. A secondary arc chute for an electrical switching apparatus, said electrical switching apparatus including a housing, a pair of separable contacts enclosed within said housing, and a primary arc chute disposed proximate said separable contacts in order to attract an arc generated by said separable contacts, said primary arc chute having a first end including an arc horn, and a second end, said secondary arc chute comprising:

a chute member including a first portion structured to be disposed at or about said arc horn of said primary arc chute, and a second portion, wherein said chute member is structured to provide an extension of said primary arc chute in order to facilitate drawing said arc away from said separable contacts, wherein the second portion of said chute member includes a pair of opposing tab extensions which extend generally vertically from said second portion; and wherein said pair of opposing tab extensions are structured to be disposed proximate said arc horn of said primary arc chute in order to further attract and dissipate said arc.

5. The secondary arc chute of claim 1 wherein said chute member is structured to cool and dissipate said arc, and to ground said arc into said housing of said electrical switching apparatus.

6. The secondary arc chute of claim 1 wherein said chute member comprises a single-piece chute member.

7. The secondary arc chute of claim 6 wherein said single-piece chute member is made from a metallic material including a number of bends.

8. The secondary arc chute of claim 1 wherein said chute member is made from a magnetic material.

9. The secondary arc chute of claim 8 wherein said magnetic material comprises nickel-plated steel.

10. An electrical switching apparatus comprising:

a housing;

separable contacts enclosed within said housing;

an operating mechanism structured to open and close said separable contacts;

a primary arc chute disposed proximate said separable contacts in order to attract an arc generated by said separable contacts, said primary arc chute including an end having an arc horn, said arc horn having a plane; and a secondary arc chute comprising:

a chute member including a first portion disposed at or about the end of said primary arc chute, and a second portion, the first portion of said chute member being structured to draw said arc out of said primary arc chute and away from said separable contacts, the second portion of said chute member being structured to ground said arc into said housing of said electrical switching apparatus, wherein said first portion of said chute member of said secondary arc chute is aligned with said plane of said arc horn of said primary arc chute.

11. The electrical switching apparatus of claim 10 wherein the first portion of said chute member includes a hook disposed proximate said arc horn at or about the end of said primary arc chute.

12. The electrical switching apparatus of claim 11 wherein said hook includes a tip comprising a first arc runner extension; wherein the second portion of said chute member includes a second arc runner extension; and wherein said first and second arc runner extensions are structured to further attract said arc away from said primary chute.

13. The electrical switching apparatus of claim 12 wherein said second arc runner extension comprises an integral tab protrusion extending from the second portion of said chute member.

14. An electrical switching apparatus comprising:

a housing;

separable contacts enclosed within said housing;

an operating mechanism structured to open and close said separable contacts;

a primary arc chute disposed proximate said separable contacts in order to attract an arc generated by said separable contacts, said primary arc chute including an end; and a secondary arc chute comprising:

a chute member including a first portion disposed at or about the end of said primary arc chute, and a second portion, the first portion of said chute member being structured to draw said arc out of said primary arc chute and away from said separable contacts, the second portion of said chute member being structured to ground said arc into said housing of said electrical switching apparatus, wherein the second portion of said chute member includes a pair of opposing tab extensions which extend generally vertically from the second portion; and wherein said pair of opposing tab extensions are structured to be disposed proximate said arc horn of said primary arc chute in order to further attract and dissipate said arc.

15. The electrical switching apparatus of claim 10 wherein said secondary arc chute coupled to at least one of said housing of said electrical switching apparatus and said primary arc chute.

16. The electrical switching apparatus of claim 15 wherein the second portion of said chute member includes an opening; and wherein said secondary arc chute further includes at least one fastener inserted through said opening in order to secure said chute member to said housing.

17. The electrical switching apparatus of claim 10 wherein said secondary arc chute has a surface area; wherein said chute member includes a number of surface area enlarging mechanisms selected from the group consisting of apertures, hooks, tab extensions, fins, and a combination of apertures, hooks, tab extensions and fins; and wherein said surface area enlarging mechanisms are structured to enlarge said surface area of said secondary arc chute in order to further dissipate and cool said arc.

18. The electrical switching apparatus of claim 10 wherein said chute member of said secondary arc chute comprises a single-piece chute member.

19. The electrical switching apparatus of claim 18 wherein said single-piece chute member is made from a magnetic material including a number of bends.

20. The electrical switching apparatus of claim 19 wherein said magnetic material comprises nickel-plated steel.

* * * * *